United States Patent [19]

Clark et al.

[11] Patent Number: 4,840,850

[45] Date of Patent: Jun. 20, 1989

[54] EMISSIVE COATING FOR X-RAY TARGET

[75] Inventors: Clarence O. Clark, Brown Deer, Wis.; Jauwhei Hong, Elk Grove, Ill.

[73] Assignee: General Electric Company, N.Y.

[21] Appl. No.: 861,523

[22] Filed: May 9, 1986

[51] Int. Cl.[4] ..... B05D 5/06; B32B 15/04

[52] U.S. Cl. ..... 428/471; 427/65; 427/126.3; 427/190; 427/376.3; 428/472

[58] Field of Search ..... 427/77, 65, 190, 376.2, 427/126.3, 422, 34; 428/472, 471

[56] References Cited

U.S. PATENT DOCUMENTS

| | | | |
|---|---|---|---|
| 2,798,179 | 7/1957 | Sheldon | 427/65 |
| 3,410,716 | 11/1968 | Hiltz | 427/34 |
| 4,132,916 | 1/1979 | Hueschen et al. | 313/330 |
| 4,257,599 | 2/1981 | McCormick | 427/34 |
| 4,600,659 | 7/1986 | Hong et al. | 427/65 |

*Primary Examiner*—Janyce Bell

*Attorney, Agent, or Firm*—Thomas R. Morrison

[57] ABSTRACT

The present invention employs a mechanical mixture of titanium dioxide and calcium oxide which is sintered and ground to produce a ceramic powder for application to a target of an X-ray tube. The powder is fused by baking the target at a predetermined baking temperature to produce a coating having an enhanced coefficient of emissivity. The required baking temperature is controllable by varying the proportion of titanium dioxide to calcium oxide. Baking time may be extended without degrading the coating by mechanically mixing zirconium dioxide to the sintered and ground ceramic powder prior to application to the X-ray target in order to enhance outgassing from the target substrate. The resulting coating on the target improves the emissivity thereof and exhibits and improved bond strength over coatings of the prior art.

9 Claims, 1 Drawing Sheet

EMISSIVE COATING FOR X-RAY TARGET

BACKGROUND OF THE INVENTION

The present invention relates to X-ray equipment and, more particularly, to emissive coatings for targets of X-ray tubes.

X-ray tubes accelerate a beam of electrons through a vacuum to high electron velocity under a high electric field toward a metallic target. When the electrons are decelerated by impact with the target, a beam of X rays is emitted by the target.

Only about one percent of the electron energy produces X rays and the remainder is dissipated as heat. It is customary to aid the dissipation of heat by applying an emissive coating to the target.

One emissive coating is a ceramic layer consisting of zirconium, calcium and titanium dioxide. This coating is made by sintering a mixture of calcium oxide, zirconium dioxide and titanium dioxide to form a ceramic mass. The ceramic mass is ground and screened for a suitable range of particle sizes such as, for example, from about 10 to about 37 microns. The powder is applied to the target by conventional plasma spray techniques. Finally, the target, including the powder coating, is baked to fuse the powder to the surface and to outgas the target.

Modern X-ray targets employ molybdenum or alloy substrates. At temperatures exceeding about 1600 degrees C., they liberate carbon. The above conventional emissive coating powder requires a baking temperature of about 1640 degrees C. to produce a smooth, adherent coating. The liberated carbon, however, reacts with the coating at the interface to produce carbon dioxide gas thus disrupting adhesion. A poorly adhering coating may result.

OBJECTS AND SUMMARY OF THE INVENTION

It is an object of the invention to provide an emissive coating for an X-ray target which overcomes the drawbacks of the prior art.

It is a further object of the invention to provide a method for coating an X-ray target with a smooth adherent coating of improved emissivity.

It is a still further object of the invention to provide a process for coating an X-ray target which extends the baking time to enhance outgassing of the target substrate. In addition, zirconium dioxide improves coating adhesion and provides a small increase in coating emissivity.

Briefly stated, the present invention employs a mechanical mixture of titanium dioxide and calcium oxide which is sintered and ground to produce a ceramic powder for application to a target of an X-ray tube. The powder is fused by baking the target at a predetermined baking temperature to produce a coating having an enhanced coefficient of emissivity. The required baking temperature is controllable by varying the proportion of titanium dioxide to calcium oxide. Baking time may be extended without degrading the coating by mechanically mixing zirconium dioxide to the sintered and ground ceramic powder prior to application to the X-ray target in order to enhance outgassing from the target substrate. The resulting coating on the target improves the emissivity thereof and exhibits an improved bond strength over coatings of the prior art.

According to an embodiment of the invention, there is provided a process for producing an emissive coating on a substrate of an X-ray target comprising: mechanically mixing from about 70 mole percent to about 90 mole percent titanium dioxide with from about 30 mole percent to about 10 mole percent calcium oxide to produce a mixture, sintering the mixture at a temperature below a melting temperature thereof to produce a ceramic mass, grinding the ceramic mass and screening to produce a ceramic powder, applying the ceramic powder to the substrate, and baking the substrate and ceramic powder at a temperature and for a time effective to fuse the ceramic powder to the substrate.

According to a feature of the invention, there is provided a coating produced by the method of the preceding paragraph.

According to a further feature of the invention, there is provided a target for an X-ray tube having a coating produced by the method.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
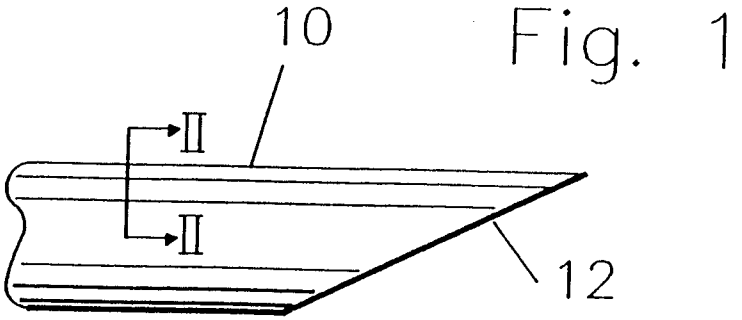
FIG. 1 is a side view of an X-ray target.

Referring first to FIG. 1, there is shown, an X-ray target 10 to which the coating of the present invention may be applied. X-ray target 10 may be of any conventional material such as, for example, molybdenum or one of the commercially available alloys of molybdenum and tungsten such as, for example, TZM or MT-104. An inclined target face 12 is impacted by a high-velocity stream of electrons in a vacuum surrounding X-ray target 10 to produce a fan-shaped X-ray beam (not shown).

As noted, the predominant part of the energy in the electron beam is dissipated as heat, with only about one percent contributing to the generation of X rays. Since X-ray target 10 is disposed in a vacuum, convective heat dissipation through a surrounding gas is not available as a technique for discharging heat. Although a small amount of heat is dissipated by conduction through the support structure, most of the heat must be dissipated by radiation. A maximum temperature permissible in X-ray target 10 limits the power in the electron beam and thus limits the X-ray output. Generally, a temperature of about 1200 degrees C. is the maximum for conventional molybdenum and alloy X-ray targets 10.

Effective radiative dissipation is equal to:

$$e*(T2\hat{}4-T1\hat{}4)$$

Where:

T2 is the absolute temperature of the emitting body,

T1 is the absolute temperature of then body absorbing the radiation, e is the coefficient of emissivity.

The coefficient of emissivity may vary widely for different materials. Generally, metals and alloys of the types from which X-ray targets 10 are made have emissivities of from about 0.1 to about 0.3. Certain materials have emissivities in excess of about 0.7 (70 percent). As a consequence, an X-ray target coated with an adhering coating which includes highly emissive material is capable of radiatively dissipating much more heat without requiring an unacceptable temperature rise in X-ray target 10 than is possible without the coating.

Figure 2:
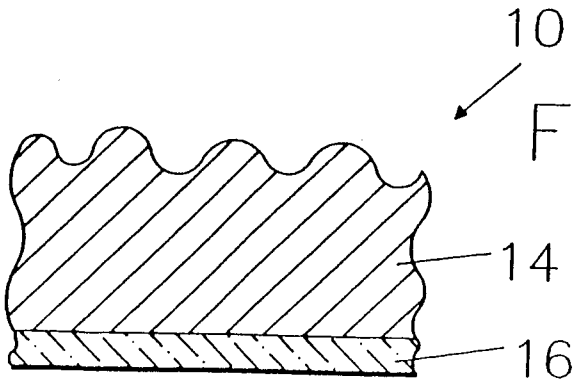
FIG. 2 is a cross section taken along II—II in FIG. 1.

Referring now to FIG. 2, X-ray target 10 includes a substrate 14 having an emissive coating 16 thereon. In the prior art, emissive coating 16 is formed by mixing and sintering from about 4 to about 8 mole percent calcium oxide with from about 96 to about 92 mole percent zirconium dioxide at a temperature of about 2000 degrees C. to produce a sintered ceramic mass (not shown) which is ground and screened to obtain a powder having a particle size range of from about 10 to about 37 micrometers. This powder is mechanically mixed with a suitable amount of titanium dioxide applied by conventional techniques such as, for example, plasma spraying, onto substrate 14 to a thickness of from about 1.0 to about 1.5 mils and is then baked to melt the powder into a smooth adherent coating. This material requires a baking temperature of about 1640 degrees C. for about 45 minutes in a vacuum of from about 10 $-6$ Torr. As a result of gas generation at the interface resulting from reduction of titanium dioxide, among other possible causes, the coating adhesion, or bond strength, is about 1000 PSI. The coefficient of emissivity of the coating is about 0.75.

We have discovered that the melting point of a sintered and re-ground mixture of calcium oxide and titanium dioxide is dependent upon the proportions of the two materials in the mixture. A mixture of about 81 weight percent titanium dioxide and 19 weight percent calcium oxide melts at about 1420 degrees C. in a vacuum. As the amount of titanium dioxide varies from about 81 weight percent, the melting temperature increases. We are thus able to control the melting temperature of the mixture by our selection of the blend of titanium dioxide and calcium oxide. Mixtures including either about 70 or about 90 mole percent titanium dioxide exhibit melting temperatures of about 1550 degrees C. Mixtures exceeding about 95 mole percent, or less than 65 mole percent, titanium dioxide have a melting temperature of about 1840 degrees C.

The above mixture of sintered and re-ground titanium dioxide and calcium oxide, when sprayed onto substrate 14 and baked at above its melting temperature for about 10 minutes, produces a smooth, adherent coating with a bond strength of about 4000 to 5000 PSI and a coefficient of emissivity of about 0.813, both of which are a substantial improvement over corresponding parameters achievable with the prior art technique.

To make the coating, a selected amount of titanium dioxide is mechanically mixed with calcium oxide. The resulting mixture is sintered at about 1200 degrees C. to produce a ceramic mass. The ceramic mass is crushed and screened to obtain a powder having particle sizes from about 10 to about 37 micrometers. The powder is applied to substrate 14 by any convenient means such as, for example, by plasma spraying, and X-ray target 10 is baked until a smooth adherent emissive coating 16 is formed. Baking can be completed at about 1500 degrees C. in about 10 minutes in a vacuum.

We have discovered that the ability to control the melting temperature is important to aspects of X-ray target 10 other than the formation of a smooth adherent coating. With the above formulation, excessive baking time tends to degrade the coating. The baking process is also employed in outgassing substrate 14. Improved outgassing may be achieved for present or future substrate 14 materials by an increased baking temperature. Increasing or decreasing the proportion of titanium dioxide in the pre-sintered mixture may be used to select a melting temperature for improved outgassing without exceeding a temperature at which carbon or other components are released from substrate 14.

Conventional substrates 14 diffuse free carbon during outgassing at about 1600 degrees. The free carbon reacts adversely with the coating. Thus, selection of a baking temperature below a substrate reaction temperature of about 1600 degrees C. is effective to avoid adhesion degradation. A melting temperature requiring a baking temperature of about 25 degrees C. below the substrate reaction temperature is sufficient to avoid undesired emissions from the substrate with their undesired reactions with the constituents of the coating. However, given the inaccuracies in industrial temperature sensors and controls, we prefer to maintain the baking temperatures at least about 50, and most preferably about 100, degrees C. below the substrate reaction temperature. Thus, a mixture containing from about 75 to about 85 mole percent titanium dioxide is preferred, and a mixture containing from about 78 to about 83 mole percent titanium dioxide is most preferred, the most preferred value being about 81 mole percent titanium dioxide.

As noted above, baking is important for achieving outgassing of substrate 14. We have discovered that the optimum baking time for outgassing is longer than the optimum baking time for melting emissive coating 16. If baking is continued long enough to achieve satisfactory outgassing, emissive coating 16 becomes crystalline and may begin to spall. We have discovered that mixing a zirconium dioxide powder with the powdered ceramic before it is applied to substrate 14, although slightly increasing the melting temperature, significantly increases the baking time which can be tolerated without degrading emissive coating 16. Satisfactory results are achieved with a percentage of zirconium dioxide of from about zero to about 50 mole percent with the preferred amount being from about 35 to about 45 mole percent of the mixture.

Besides zirconium dioxide, we believe that improved results are also attainable using aluminum, yttrium, magnesium and silicon materials, among others.

It is well to summarize the difference between the prior-art coating and the coating of the present invention. The prior-art coating is produced by mechanically mixing calcium oxide and zirconium dioxide, sintering the mixture to produce a ceramic mass, grinding and screening the ceramic mass to produce a powder and mixing the powder with titanium dioxide before applying the mixture to substrate 14. The present invention mixes and sinters calcium oxide and titanium dioxide in proportions to control the final melting temperature. After sintering, the resulting ceramic is ground and screened and the resulting powder is either used directly, or receives zirconium dioxide powder in a proportion desired to extend the baking time. The prior-art coating requires a baking temperature above a substrate-reaction temperature whereas the coating of the present invention can have its melting temperature at least 25 degrees C. below the substrate reaction temperature. In addition, the melting temperature of the coating of the present invention can be tailored by varying the proportions of titanium dioxide and calcium oxide in the pre-sintered mixture.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

The invention claimed is:

1. A process for producing an emissive coating on a substrate of an X-ray target comprising:

mechanically mixing from about 70 mole percent to about 90 mole percent titanium dioxide with from about 30 mole percent to about 10 mole percent calcium oxide to produce a mixture;

sintering said mixture at a temperature below a melting temperature thereof to produce a ceramic mass;

grinding and screening said ceramic mass to produce a ceramic powder;

applying said ceramic powder to said substrate;

baking said substrate and ceramic powder at a temperature and for a time effective to fuse said ceramic powder to said substrate and said temperature being below a temperature which permits emission from the substrate which reacts with said coating.

2. A process according to claim 1 wherein the step of mechanically mixing includes from about 75 to about 85 mole percent titanium dioxide.

3. A process according to claim 1, further comprising adding a proportion of zirconium dioxide to said ceramic powder before applying to said substrate in sufficient amount to increase the baking time of said coating thereby improved outgassing of said substrate is achieved without degrading said coating.

4. A process according to claim 3 wherein said proportion is less than 50 mole percent.

5. A process according to claim 4 wherein said proportion is from about 35 to about 45 mole percent.

6. A process according to claim 3 wherein said proportion is effective for controlling said time to a value at least great enough to achieve outgassing of said substrate.

7. A process according to claim 1 wherein the step of mechanically mixing includes proportioning said titanium dioxide to said calcium oxide in a proportion effective to control a melting temperature of said ceramic powder at said fusing temperature.

8. A process according to claim 1 wherein the step of mechanically mixing includes proportioning said titanium dioxide and said calcium oxide in proportions effective to produce a ceramic powder which may be baked at a temperature at least 25 degrees C. below a substrate reaction temperature.

9. A target for an X-ray tube having a coating produced by the method of claim 1.

* * * * *

UNITED STATES PATENT AND TRADEMARK OFFICE

CERTIFICATE OF CORRECTION

PATENT NO. : 4,840,850

DATED : June 20, 1989

INVENTOR(S) : Clarence O. Clark and Jauwhei Hong

It is certified that error appears in the above-identified patent and that said Letters Patent is hereby corrected as shown below:

Col. 3, line 24, change "10 -6" to --10^-6--.

Signed and Sealed this

Twenty-seventh Day of November, 1990

*Attest:*

HARRY F. MANBECK, JR.

*Attesting Officer*

*Commissioner of Patents and Trademarks*